United States Patent [19]

Nakamura et al.

[11] 4,094,276

[45] June 13, 1978

[54] INTAKE MANIFOLD FOR INTERNAL COMBUSTION ENGINE

[75] Inventors: Akihisa Nakamura, Tokyo; Takashi Umemoto, Tokorozawa; Sakuji Arai, Wako, all of Japan

[73] Assignee: Honda Giken Kogyo Kabushiki Kaisha, Tokyo, Japan

[21] Appl. No.: 677,669

[22] Filed: Apr. 16, 1976

[30] Foreign Application Priority Data

Apr. 24, 1975 Japan ..... 50-49087

[51] Int. Cl. ..... F02b 75/18

[52] U.S. Cl. ..... 123/52 M; 123/52 MC

[58] Field of Search ..... 123/52 M, 52 MC, 52 MV

[56] References Cited

U.S. PATENT DOCUMENTS

| | | | |
|---|---|---|---|
| 1,942,227 | 1/1934 | Timian | 123/52 M |
| 2,016,696 | 10/1935 | Timian | 123/52 M |
| 2,020,592 | 11/1935 | Timian | 123/52 M |
| 2,034,397 | 3/1936 | Kalb et al. | 123/52 M |
| 2,065,630 | 12/1936 | Timian et al. | 123/52 M |
| 2,066,922 | 1/1937 | Wolfard | 123/52 M |
| 2,068,117 | 1/1937 | Timian | 123/52 M |
| 2,137,802 | 11/1938 | Ginn | 123/52 M |
| 4,029,063 | 6/1977 | Tanaka et al. | 123/52 M |

*Primary Examiner*—Alan Cohan
*Assistant Examiner*—G. L. Walton
*Attorney, Agent, or Firm*—Lyon & Lyon

[57] ABSTRACT

The intake manifold for supplying air-fuel mixture from a single source to a plurality of cylinders of an internal combustion engine employs individual pipes all having the same cross sectional area but having different non-circular cross sectional contours. Where less fuel is needed at low engine speed and power output, the bottom half of each intake pipe is formed with a smaller internal radius of curvature than the top half. Where more fuel is needed at low engine speed and power output, the bottom half of each pipe is formed with a larger internal radius of curvature than the top half. The purpose is to better equalize the distribution of fuel to the cylinders under low speed and low power operation of the engine, without affecting fuel distribution at higher engine speeds.

6 Claims, 10 Drawing Figures

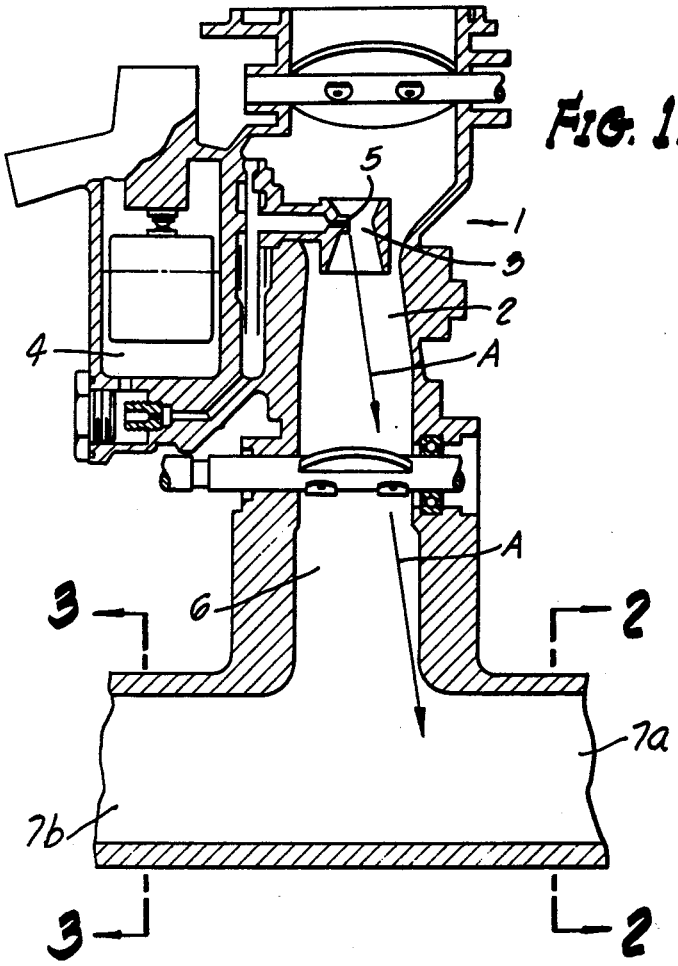
FIG. 1.
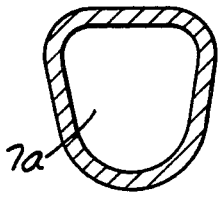
FIG. 2.
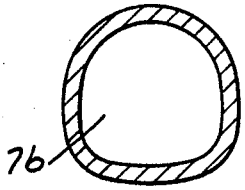
FIG. 3.
FIG. 4.
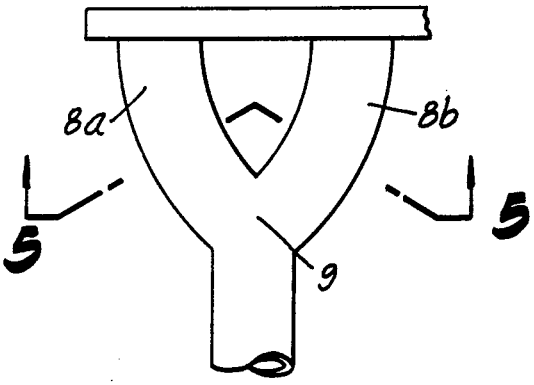
FIG. 5.
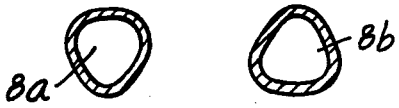

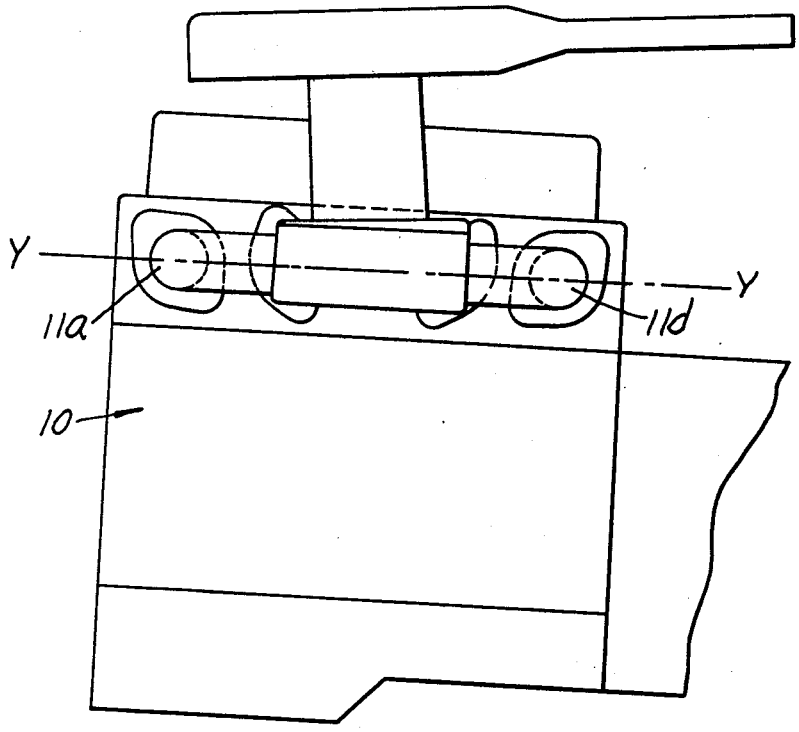
FIG. 6.
FIG. 8.
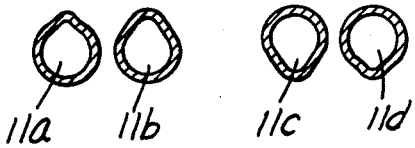
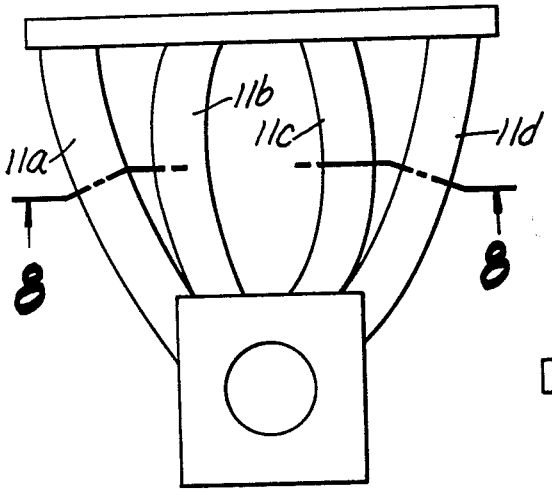
FIG. 7.
FIG. 9.
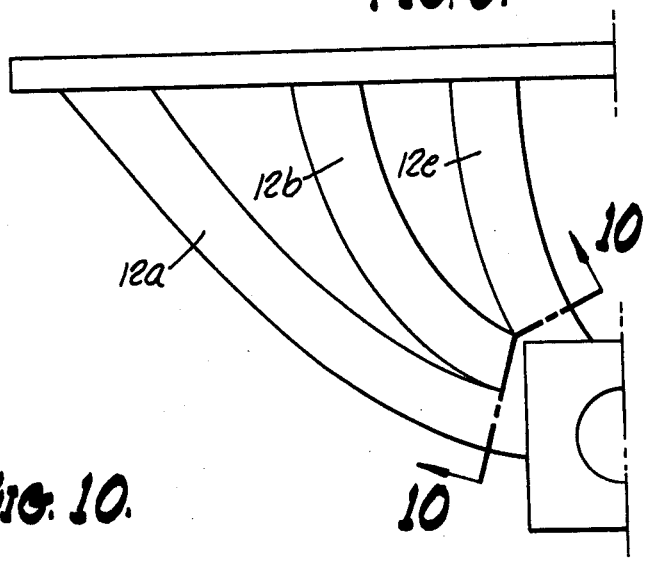
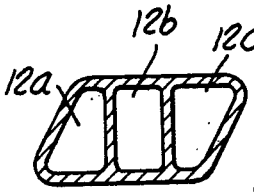
FIG. 10.

INTAKE MANIFOLD FOR INTERNAL COMBUSTION ENGINE

This invention relates to an intake manifold for an internal combustion piston engine having a plurality of cylinders.

In order to reduce harmful components in the exhaust gases, internal combustion engines have been operated on an air-fuel mixture which is so lean as to be close to the combustibility limits. In such cases the distribution characteristics of the lean mixture to the several cylinders becomes particularly important. If uneven concentrations of air-fuel mixture are delivered to the cylinders, a mixture that is too rich may well result in an increase of $NO_x$ in the exhaust gases, whereas a mixture that is too lean is likely to result in a misfire, increasing CO and HC in the exhaust gases. The unequal concentrations may result from several different causes, for example, because of the characteristics of the carburetor, or a tilt in the arrangement of the intake passages, or a difference in the length of the intake pipes.

It has been found that air-fuel mixtures of the type under consideration tend to separate when the flow rate is relatively low, for example, when the engine speed is low and the power output is low. In such cases the fuel components and the air components tend to separate with the fuel components moving downward in the intake pipes and the air components moving upward. However, when the flow rate is high, for example, when the engine power output and speed are high, the tendency toward separation disappears. Accordingly, it has been found that when the mixture flows at low speed, the sectional contour of each intake passage has an important effect on the separation characteristics, and when the mixture flows at high speed, only the cross sectional area of the intake passages is important.

Other and more detailed objects and advantages will appear hereinafter.

In the drawings:

FIG. 1 is a sectional elevation showing a carburetor for supplying an air-fuel mixture to oppositely extending intake pipes.

FIG. 2 is a sectional elevation taken substantially on the lines 2—2 as shown in FIG. 1.

FIG. 3 is a sectional elevation taken substantially on the lines 3—3 as shown in FIG. 1.

FIG. 4 is a plan view showing a pair of intake pipes which branch from a common supply pipe.

FIG. 5 is a sectional elevation taken substantially on the lines 5—5 as shown in FIG. 4.

FIG. 6 is a side view of a four cylinder engine which is tilted longitudinally in its installed position.

FIG. 7 is a plan of the intake manifold as shown in FIG. 6.

FIG. 8 is a sectional elevation taken substantially on the lines 8—8 as shown in FIG. 7.

FIG. 9 is a plan view partly broken away showing intake pipes for a six cylinder engine, the pipes being of different lengths.

FIG. 10 is a sectional elevation taken substantially on the lines 10—10 as shown in FIG. 9.

Referring to the drawings, the form of the invention shown in FIGS. 1-3 includes a carburetor 1 having a carburetor passage 2 within it which is substantially vertical. A fuel nozzle 5 projects into the venturi passage 3 and is connected to a float chamber 4. At the downstream end of the carburetor passage 2 there is provided a distribution chamber 6 from which a pair of intake passages **7*a* and 7*b*** are branched off forward and rearward leading to the cylinders of the engine.

The air that flows downward through the venturi passage 3 and the carburetor passage 2 causes a flow of liquid fuel to emerge through the opening at the tip of the nozzle 5, but the flow of fuel, particularly at low flow rates, is inclined in the direction of the opening of the nozzle 5, and instead of extending axially through the center of the distribution chamber 6, is offset in a forward direction toward the branch intake passage **7*a*, as shown by the arrows A—A. The result is that there is an uneven distribution of fuel in which a greater amount passes into the intake passage 7*a* and a smaller amount passes into the intake passage 7*b***. This unequal distribution effect is particularly noticeable at low power output and low speed of the engine.

In order to correct this uneven distribution of fuel into the branch intake passages **7*a* and 7*b*, the internal section contour of the intake passages 7*a* is reduced in the lower half thereof, as shown in FIG. 2, and the internal sectional contour of the intake passage 7*b* is enlarged in the lower half thereof, as shown in FIG. 3. Thus there is utilized the phenomenon that the air-fuel mixture at low flow rates tends to separate as described above into fuel components which flow in the lower portion of the passage and the air companents which flow in the upper portion of the passage. Accordingly, the lower portion of the intake passage 7*a* which carries the greater proportion of fuel components is reduced in size while the upper portion that carries the air components is increased in size. Conversely, the lower portion of the passage 7*b* is increased in size and the upper portion thereof is reduced in size. The internal contours are smooth and without discontinuities. In this way the distribution characteristics are improved. When the engine is operating at high power output and high speed, the flow rate of the air-fuel mixture is high, and there is no observed tendency of separation of the fuel components and the air components, and there is very little effect of the offset flow of fuel from the fuel nozzle 5. In this case the distribution characteristics depend largely upon the internal cross sectional area of the two passages 7*a* and 7*b***, and accordingly both are constructed to have equal internal cross sectional area.

FIGS. 4 and 5 show a modified form of the invention in which a pair of intake passages **8*a* and 8*b* branch off left and right from a distribution chamber 9. Intake valves (not shown) downstream from the intake pipes 8*a* and 8*b* are known to overlap in their operating cycle. The intake passage 8*a* connected to the first cylinder is made to have an internal sectional contour reduced in the lower portion thereof and the intake passage 8*b* connected to the second cylinder is enlarged in the lower portion thereof. Accordingly, the fuel components are increased for the intake passage 8*b* where overlapping occurs in the neighborhood of valve closing. Both passages 8*a* and 8*b*** have equal cross sectional area. They are smooth and without internal discontinuities.

FIGS. 6-8 show a modification in which correction is made to uneven distribution of fuel as a result of mounting of the engine 10 in a slightly tilted position. Thus, the line of intake ports Y — Y is higher at the left than at the right, as viewed in FIG. 6. The four intake passages **11*a*, 11*b*, 11*c* and 11*d* in that order have a tendency of becoming higher and higher in the fuel concentration carried, depending upon their relative elevation. Thus, the passage or pipe 11***a* carries the least fuel concentration at low power output and low engine speed, while pasage 11*d* carries the greatest fuel concentration. To compensate, the internal sectional contours are enlarged in the lower portion of the pipes on th left and are reduced in the lower portion of pipes on the right, as shown in FIG. 8. All of the passages have the same cross sectional area. They are smooth and without internal discontinuities.

In the modifications shown in FIGS. 9 and 10, intake passages for a six cylinder engine are shown. FIG. 9 shows only three of them; the other three are symmetrically positioned. The intake pipes 12*a*, 12*b* and 12*c* have decreasing lengths in that order. In accordance with this invention, the longest pipe 12*a* is provided with an internal sectional contour enlarged in the lower portion; the shortest pipe 12*c* is provided with a sectional contour reduced in its lower portion; and the pipe 12*b* of intermediate length is provided with a sectional contour which is symmetrical between its upper and lower portions. Each of the pipes has the same cross sectional area. They are smooth and without internal discontinuities.

In each of the forms of the invention described above, at least two intake passages branch off from a common source or distribution chamber, and at least one of them has an internal sectional contour which is asymmetrical when considering its upper and lower portions. At low engine output and low engine speed, the enlargement of the lower portion, for example, causes the fuel components carried by the pipe to increase, and by having the lower portion reduced, the fuel components are decreased. In this way, an unevenness in fuel distribution can be corrected. In any case, both passages are made to have an equal cross sectional area, so that equal fuel distribution is achieved at high power output and high speed of the engine.

Having fully described our invention, it is to be understood that we are not to be limited to the details herein set forth but what our invention is of the full scope of the appended claims.

We claim:

1. An intake manifold for delivering an air-fuel mixture to an internal combustion engine having a plurality of cylinders, comprising: a first pipe leading from a mixture source for supplying air-fuel mixture to one of the engine cylinders, a second pipe leading from the same mixture source for supplying air-fuel mixture to another cylinder of the engine, the pipes having substantially the same constant internal cross sectional area, with smooth internal contours without discontinuities, the pipes each being non-circular in cross section, one of the pipes having an asymmetrical internal sectional contour in which the lower portion thereof is smaller than the upper portion thereof, the other pipe having an asymmetrical internal sectional contour in which the lower portion thereof is larger than the upper portion thereof.

2. The device of claim 1 in which the mixture source is a carburetor.

3. The device of claim 1 in which the two pipes are adapted for connection to engine cylinders having intake valve overlap.

4. The device of claim 1 in which the engine is tilted in its installation mounting so that its intake ports are positioned at different levels, each pipe being adapted for connection to at least one of said intake ports.

5. The device of claim 1 in which said pipes are unequal in length.

6. An intake manifold for delivering an air-fuel mixture to an internal combustion engine having a plurality of cylinders, comprising: a first pipe leading from a mixture source for supplying air-fuel mixture to one of the engine cylinders, a second pipe leading from the same mixture source for supplying air-fuel mixture to another cylinder of the engine, the pipes having substantially the same constant internal cross sectional area, the pipes each being non-circular in internal cross section, one of the pipes having a smooth sectional contour without discontinuities in which a lower portion is provided with a smaller radius of curvature than its upper portion, the other pipe having a smooth sectional contour without discontinuities in which a lower portion is provided with a larger radius of curvature than its upper portion.

* * * * *